United States Patent [19]

McVey et al.

[11] Patent Number: 5,076,053

[45] Date of Patent: Dec. 31, 1991

[54] MECHANISM FOR ACCELERATING HEAT RELEASE OF COMBUSTING FLOWS

[75] Inventors: John B. McVey; Roy Pelmas, both of Glastonbury; Robert W. Paterson, Simsbury, all of Conn.; Walter M. Presz, Jr., Wilbraham, Mass.; Michael J. Werle, West Hartford, Conn.

[73] Assignee: United Technologies Corporation, Hartford, Conn.

[21] Appl. No.: 391,916

[22] Filed: Aug. 10, 1989

[51] Int. Cl.[5] ..... F02K 3/10

[52] U.S. Cl. ..... 60/261; 60/749

[58] Field of Search ..... 60/261, 262, 733, 749

[56] References Cited

U.S. PATENT DOCUMENTS

| | | | |
|---|---|---|---|
| 3,750,402 | 8/1973 | Vdoviak et al. | 60/261 |
| 3,788,065 | 1/1974 | Markowski | 60/39.02 |
| 3,930,370 | 1/1976 | Markowski et al. | 60/261 |
| 3,937,008 | 2/1976 | Markowski et al. | 60/39.06 |
| 3,973,395 | 8/1976 | Markowski et al. | 60/39.65 |
| 3,974,646 | 8/1976 | Markowski et al. | 60/39.65 |
| 4,045,956 | 9/1977 | Markowski et al. | 60/39.65 |
| 4,058,977 | 11/1977 | Markowski et al. | 60/39.65 |
| 4,145,878 | 3/1979 | Markowski | 60/261 |
| 4,145,879 | 3/1979 | Markowski | 60/261 |
| 4,145,880 | 3/1979 | Markowski | 60/261 |
| 4,776,535 | 10/1988 | Paterson et al. | 244/130 |
| 4,786,016 | 11/1988 | Presz, Jr. et al. | 244/130 |
| 4,789,117 | 12/1988 | Paterson et al. | 244/130 |
| 4,813,633 | 3/1989 | Werle et al. | 244/130 |
| 4,813,635 | 3/1989 | Paterson et al. | 244/130 |
| 4,815,531 | 3/1989 | Presz, Jr. et al. | 165/151 |
| 4,830,315 | 5/1989 | Presz, Jr. et al. | 244/200 |
| 4,835,961 | 6/1989 | Presz, Jr. et al. | 60/264 |
| 4,971,768 | 11/1990 | Ealba et al. | 422/176 |

FOREIGN PATENT DOCUMENTS

| | | | |
|---|---|---|---|
| 832641 | 4/1960 | United Kingdom | 60/262 |

*Primary Examiner*—Stephen C. Bentley

*Attorney, Agent, or Firm*—Stephen E. Revis

[57] ABSTRACT

In a combustion process streams of fuel, oxidant or combinations of fuel and oxidant pass simultaneously through a combustion region over opposite sides of a plate disposed therein having downstream extending convolutions which create pairs of large scale oppositely rotating vortices. These vortices cause the fuel and oxidant to mix rapidly with each other. A recirculation zone is disposed immediately downstream and adjacent the edge of the convoluted plate, and in one embodiment is created by a step-wise discontinuity in the flowpath. The mixing occurs without introducing large momentum losses and, when the mixture is ignited immediately downstream of the convoluted plate, the flame propagates with a larger than normal spreading angle.

14 Claims, 2 Drawing Sheets

*fig. 5*
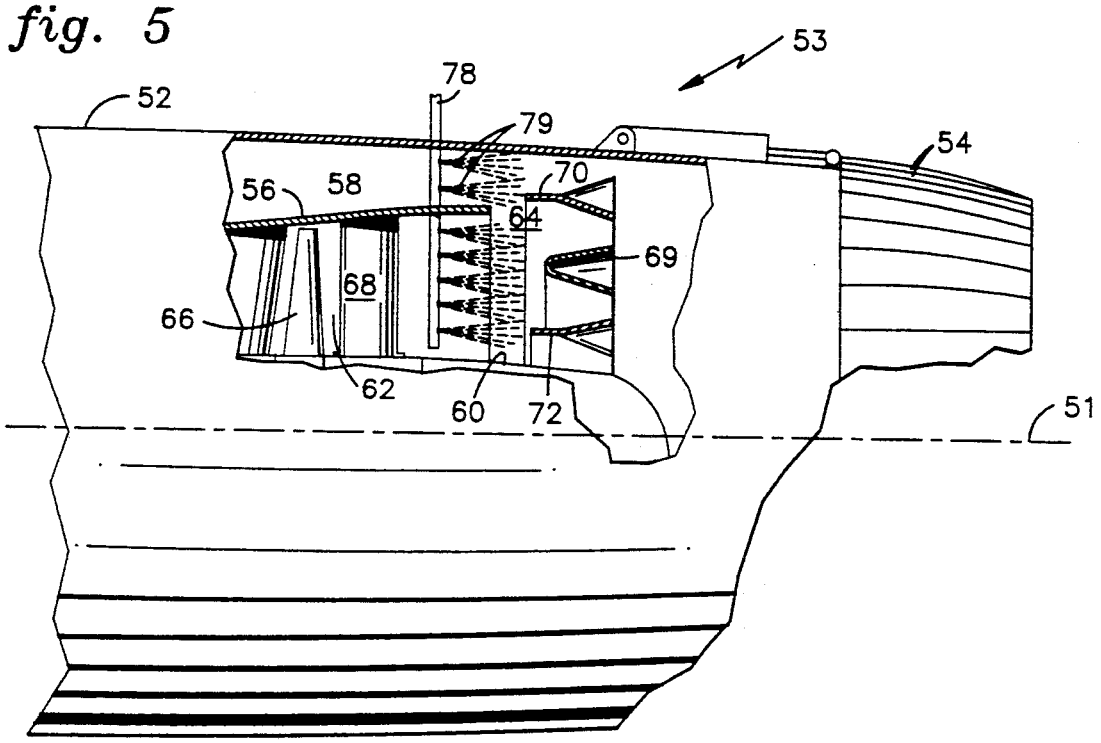
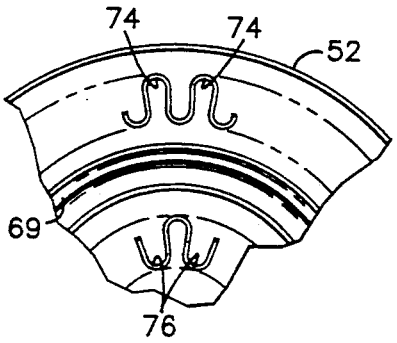
*fig. 6*

MECHANISM FOR ACCELERATING HEAT RELEASE OF COMBUSTING FLOWS

The invention was made under a U.S. Government contract and the Government has rights therein.

DESCRIPTION

1. Technical Field

This invention relates to combustion chambers.

2. Background Art

The achievement of increased rates of flame propagation in confined, turbulent, high-speed streams has been a goal of combustion engineers since the first efforts to design jet propulsion engines. Experimental efforts to evaluate the influence of fuel-air ratio, approach flow turbulence level, pressure and initial temperature on the spreading angle of confined flames have shown that the time-mean spreading angle varies only slightly in a range of from 3° to 7°. These results, applicable to flames wherein the characteristic flow velocity is orders of magnitude higher than the burning velocity of the mixture, are consistent with a physical model in which the shear interaction between the differentially accelerated low density combustion products and the high density unburned gases acts to produce turbulence which controls the mixing rate. In other words, the shear-generated turbulence effects dominate all other fluid mechanic phenomena. As a consequence, practical means of shortening combustion chambers have been limited to the use of flame holders at multiple locations or the use of swirlers.

Swirlers generate a secondary component of velocity which leads to significant shear-produced turbulence. Swirlers also produce unstable fluid flows which result in large scale convective mixing. The increased turbulence and increased mixing allow the gases to finish burning in a shorter axial distance.

Flame holders do not significantly increase the spreading angle of the flame. They provide a low velocity region of flow to which the upstream end of the flame can remain stabilized or attached once the gases are ignited. By disposing a sufficient number of flame holders sufficiently close together within a combustion chamber, the flames propagating behind each of the flame holders will merge together and cover the entire cross section of the combustion chamber in a relatively short distance despite the shallow spreading angle of each flame. If the flame spreading angle could be increased, it is apparent that fewer flame holders would be required and the individual flames would spread out and merge together to completely fill the combustion chamber within a shorter distance while introducing less momentum loss.

Unfortunately, flame holders and swirlers that introduce significant axial momentum losses in high velocity streams. Swirlers can also induce a net angular momentum which is detrimental and needs to be counteracted in aircraft gas turbine engines. Thus, although it has long been known that, if the flame spreading angle is increased, the combustion chamber length may be shortened, it has not heretofore been possible to do so without introducing significant momentum losses into the flow streams.

DISCLOSURE OF THE INVENTION

One object of the present invention is to increase the flame propagation angle within a combustion chamber.

Another object of the present invention is to simultaneously mix and rapidly burn, within a combustion chamber, two separate streams of downstream flowing fluids comprising (between the two of them) fuel and an oxidant, the mixing being accomplished without introducing large momentum losses.

According to the present invention, in a combustion process within a confined space, streams of fuel, oxidant, or combinations thereof pass simultaneously over opposite sides of a convoluted, downstream extending plate which creates pairs of large scale oppositely rotating vortices of such fluids which, in turn, cause the fluids to mix rapidly with each other such that, when ignited immediately downstream of the convoluted plate, they burn rapidly while they are mixing.

As used in this specification and appended claims, "large scale" vortices have diameters on the order of the maximum trough depth. The invention is particularly useful for aircraft gas turbine engine combustion chambers, but is not intended to be limited thereto.

The convolutions are downstream extending lobes and troughs which initiate smoothly from the plate upstream surface and increase in height and depth to a wave shaped downstream edge of the plate. Convoluted plates for generating large scale counterrotating vortices in fluids flowing on opposite sides thereof are described in commonly owned U.S. Pat. Nos. 4,776,535; and 4,835,961, which are incorporated herein by reference. Those patents show convoluted plates used to reduce the base drag behind a moving object (the '535 patent) and as part of a low loss ejector (the '961 patent) which rapidly mixes together flows on opposite sides of such convoluted plate.

In one embodiment of the present invention, a convoluted plate is disposed within a combustion chamber for the purpose of more rapidly mixing and simultaneously burning streams containing fuel and oxidant flowing downstream therethrough while avoiding the introduction of significant momentum losses typically associated with prior art efforts to accomplish the same purposes. A volume of air, for example, flows downstream over one side of the convoluted plate at a fast rate of speed and without any substantial angular momentum. Another volume of fluid, also having no net angular momentum and containing, for example, fuel, flows downstream over the other side of the plate at the same or different speed. The convolutions are sized and contoured to generate pairs of large scale counterrotating vortices which rapidly mix the air and fuel without generating significant momentum losses. Once ignited immediately downstream of the trough outlets, the mixture burns rapidly. Assuming the flame remains attached, such as to a recirculating flow region adjacent the plate, the flame can propagate with a larger than normal spreading angle. The invention is particularly useful when the fluid velocity on one side of the plate is several times faster than the bulk fluid velocity on the other side of the plate.

The lobes must have sufficient height, relative to the flow path height, to create vortices which will be large enough to effect mixing together of a significant portion, if not all, of the bulk fluid before the vortices dissipate. If a single plate is spaced between two opposing walls of the combustor flow path, the height of the lobes is preferably sufficient to create vortices which will influence flow across the entire combustor flow path before the vortices dissipate. If the distance (in the lobe height direction) between the opposing combustion chamber walls is "X", then the amplitude of the lobes at their downstream end should be at least 25% of X to achieve good results. (Dimension H shown and discussed hereinafter with respect to FIG. 2 corresponds to the distance X.)

In addition to lobe height (or trough depth), the intensity of the vortices is also affected by the slope of the trough sidewalls and the slope of the trough floor. Preferably the sidewalls of the troughs are parallel to each other. Also, as long that the troughs flow full over their length (i.e., no flow separation occurs within the troughs), it is best to have as steep an angle as possible between the trough floor and the direction of entry of the fluid in the trough. That angle is hereinafter referred to as the trough "slope". The troughs in at least one side of the plate should have slopes of at least 10°, preferably at least 15°. Slopes of more than about 25° are likely to have flow separation therewithin and are not recommended.

If the trough sidewalls are parallel to each other, as preferred, the trough will have what is herein referred to as an aspect ratio which is defined as trough depth divided by trough width, at the trough outlet end. Aspect ratios may be as high as 10 but are preferably less than 7.5. If troughs are too deep relative to their width, boundary layer build-up may disrupt the vortex formation. Troughs with aspect ratios which are too low may not generate sufficiently intense vortices. Both sides of the plate should have troughs with an aspect ratio of at least 1.0. Preferably the troughs on at least one side of the plate have an aspect ratio of at least 2.0.

To generate strong vortices the lobes and troughs should be smoothly U-shaped along their length in transverse cross section. Sharp internal or external corners create losses and reduce the intensity of and may even prevent the formation of useful vortices.

With high speed fluid flows, in order to achieve the increased flame spreading angle of the present invention and to keep the flame from being swept downstream before complete burning takes place, a recirculating flow region must be maintained adjacent and immediately downstream of the trough outlets along the length of the convoluted edge. The fuel and oxidant mixture is ignited in this region; and the upstream end of the flame remains attached thereto during combustion. However, such recirculation region must be transversely offset from the trough outlets to avoid disrupting the formation of the vortices.

A recirculating flow region may be created by any suitable means, such as by a bluff body disposed in a flow stream, similar to a conventional flame holder of an aircraft gas turbine engine. If the convoluted plate downstream edge is disposed close to the combustor wall, the wall could have a step in it near the edge of the plate with a recirculating flow region being created behind (i.e., downstream) of the step. The step also provides additional transverse space for the vortices to properly form downstream of the convolutions.

The following patents describe convoluted separator plates and devices to otherwise mix flows within a combustor: U.S. Pat. Nos. 3,788,065; 3,930,370; 3,937,008; 3,973,395; 3,974,646; 4,045,956; 4,058,977; 4,145,878; 4,145,879 and 4,145,880. These patents are all assigned to the assignee of the present invention, and Stanley Markowski is either a sole or joint inventor of each. Attempting to mix together fluid streams, these inventions rely on a net angular momentum of the flows to accomplish their purpose of mixing fluids. The convolutions are referred to as "triggers" to generate turbulence at the interfaces of the fluids coming off of opposite sides of the plate. Note that these convolutions have non-parallel sidewalls; and the trough depth to width ratio is generally on the order of 1.0 on both sides of the convolutions. They are not designed to generate large scale, counterrotating vortices. Further, many of these patents show the use of these convoluted triggers to mix fluids well upstream of where ignition takes place. Therefore, they have little, if any, impact as a combustion rate modifier.

The foregoing and other objects, features and advantages of the present invention will become more apparent in the light of the following detailed description of preferred embodiments thereof as illustrated in the accompanying drawings.

BRIEF DESCRIPTION OF THE DRAWINGS

FIG. 5 is an illustrative, schematic view of a portion of a gas turbine engine afterburner duct incorporating the present invention.

FIG. 6 is a view taken in the direction 6—6 of FIG. 5.

BEST MODE FOR CARRYING OUT THE INVENTION

Figure 1:
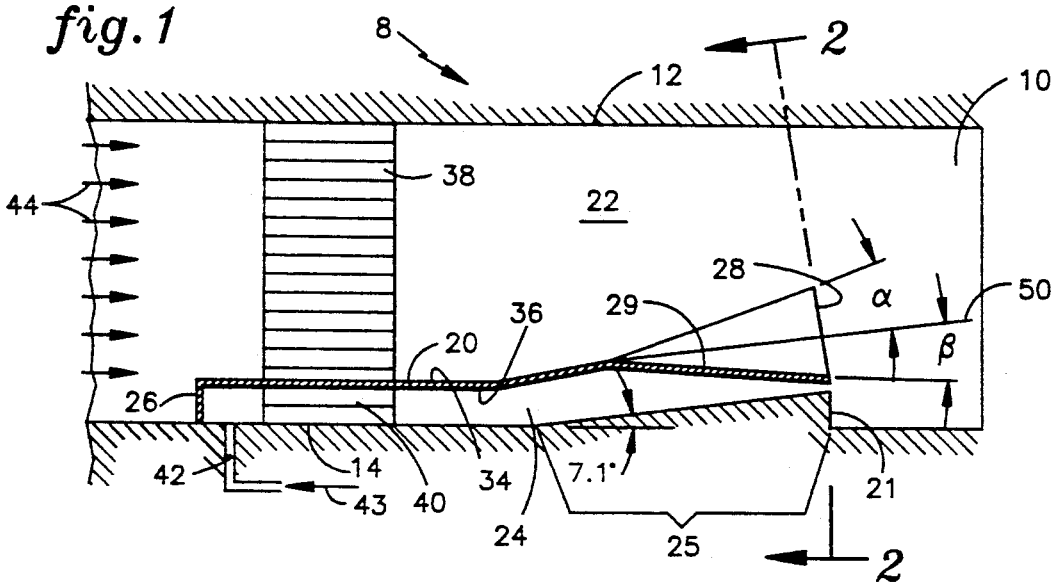
FIG. 1 is an illustrative, partly schematic view of combustion apparatus incorporating the present invention.
Figure 2:
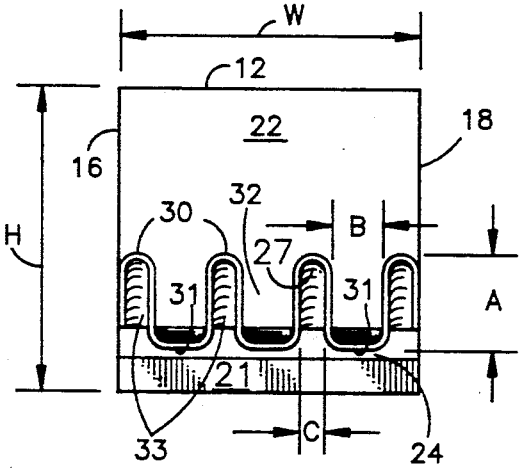
FIG. 2 is a sectional view taken along the line 2—2 of FIG. 1.

A combustion chamber 8 according to the present invention is illustrated in FIGS. 1 and 2. The combustion chamber 8 is actually combustion apparatus designed for the purpose of testing the present invention. The chamber 8 comprises a conduit 10 having opposed upper and lower walls 12, 14, respectively, and opposed side walls 16, 18, respectively. The conduit is rectangular in cross section along its length. Disposed within the conduit and extending from the side wall 16 to the side wall 18 is a splitter or separator plate 20. The plate 20 is spaced from both the upper and lower walls 12, 14 and divides a portion of the conduit length into upper and lower channels 22, 24, respectively. The upstream end of the lower channel 24 is blocked by a transversely extending wall portion 26 of the plate 20.

A downstream portion of the plate 20 is convoluted to the downstream edge 28 of the plate. The convolutions form a plurality of adjoining, alternating upper channel lobes 30 and upper channel troughs 32 in the upper surface 34 of the separator plate 20. Similarly, a plurality of adjoining, alternating, lower channel lobes 31 and lower channel troughs 33 are formed in the lower surface 36. The lobes and troughs initiate at zero height and depth respectively, and extend downstream increasing gradually to their maximum height and depth at the downstream edge 28. The troughs and lobes are smoothly U-shaped in cross section along their length and blend smoothly into one another. As is most preferred, the sidewalls of each trough 32, 33 are parallel to each other.

Flow straightening devices 38, 40, which may be vanes or other suitable means, are disposed within each channel 22, 24 well upstream of the convolutions in the plate 20 to remove any angular momentum from the bulk fluid flowing within each channel.

In operation, a fluid 43 is introduced into the lower channel 24, upstream of the straightening device 40, by means of one or more tubes 42. Another fluid, represented by the arrows 44, is introduced into the upstream end of the upper channel 22, upstream of the straightening device 38.

In tests of this apparatus, which are hereinafter to be described, the fluid 44 is air, which is the oxidant for the combustion process; and the fluid 43 is triethylborane ("TEB"), the fuel for the combustion process. TEB is a pyrophoric fuel which has a reasonably short ignition delay time and which, being pyrophoric, ignites spontaneously in the presence of oxygen. To avoid the necessity of employing actively-cooled hardware, nitrogen is mixed with the pyrophoric fuel. The nitrogen is heated to a temperature of 500K such that the liquid TEB readily vaporizes when injected.

In this exemplary embodiment, the upper and lower walls 12, 14 are parallel to each other along an upstream portion of the conduit. Near the downstream end of the channel 24 the lower wall 14 is canted upward toward the upper wall 12 and toward the plate 20, thereby forming a ramp 25. At the very end of the channel 24 or ramp 25, the wall 14 jogs outwardly transversely to the downstream direction. It then jogs downstream so that it is again parallel to the upper wall 12 and is the same distance from the upper wall 12 as it was upstream of the ramp 25. The jog creates a downstream facing transversely extending wall surface 21. A sudden increase in the conduit cross-sectional flow area thereby occurs at the end of ramp 25.

At the point where the outer wall 14 begins to ramp upwardly, the separator plate surface is also canted upwardly such that the flow area within the channel 24 remains constant with streamwise distance. The flow area of the upper channel 22 over the convoluted portion of the plate 20 undergoes a slight contraction in the downstream direction. That contraction is not considered significant for purposes of the tests hereinafter described or for the present invention.

For purposes of this specification and the invention described herein, a straight extension of the portion of the separator plate immediately upstream of the convolutions defines a plane 50. The direction of fluid flow entering a trough is thus parallel to the plane 50. In this embodiment, if the plate 20 were extended along the plane 50, the cross-sectional flow area of the lower channel 24 would remain constant. This plane 50, which is herein referred to as the base-plane 50 of the convolutions, is useful for describing the convolution geometry, as set forth below.

Referring to FIG. 1, in this test apparatus the ramp angle of the lower wall 14 is 7.1 degrees.

The angle $\alpha$ is called the lower trough profile angle and is the angle that the floors 27 of the lower troughs 33 form with the base-plane 50. The angle $\beta$ (upper trough profile angle) is the angle between the floors 29 of the upper troughs 32 and the base-plane 50. The angles $\alpha$ and $\beta$ may also be referred to as the "slopes" of the lower and upper troughs, respectively The aspect ratio of a trough is herein defined as its depth divided by its width. The troughs 32, 33 have a depth herein designated A (also referred to as lobe height or lobe amplitude). If the upper troughs 32 have a width B and the lower troughs 33 have a width C, the aspect ratio of the upper troughs will be A/B and the aspect ratio of the lower troughs will be A/C.

In one embodiment of the present invention which was tested, the angle $\alpha$ was 15°; the angle $\beta$ was 7.4°; the upper trough aspect ratio A/B was 1.7 and the lower trough aspect ratio A/C was 4.6. The lobe amplitude A was 4.9 cm. The area ratio between the upper and lower channels at the trough exit plane was 5.74. The overall channel height H was 14 cm and the overall channel width was also 14 cm. The height of the surface 21 (i.e. the step) was 2.0 cm. The lobe height at the exit plane of the troughs was 41% of the channel height at the end of the ramp (35% of the 14 cm channel height H).

In tests of this configuration, the velocity of the upper stream was varied between 19.8 to 76.2 meters per second. The ratio of the velocity of the upper stream to the velocity of the lower stream was varied between 0.7 and 5.0. Equivalence ratios were varied from 0.13 to 0.54. The temperature of the air stream 44 supplied to the combustion chamber 8 was held fairly constant at about 289° K. The fuel supply stream temperature varied between 528° to 639° K. It is not believed that stream temperature variations had any significant effect on the results of the tests.

As a measure of the extent to which the present invention achieved its objectives, the flame envelope within the combustion chamber was viewed through a window in the sidewall of the conduit. The window extended essentially the height of the conduit. The upstream edge of the window was located at the edge 28 of the separator plate 20. The downstream length of the window was about 65 cm.

In four representative tests of the exemplary embodiment of the present invention as described above, the flame envelope covered 78, 84, 90 and 90%, respectively, of the window. For comparison purposes, similar tests were run with the convoluted portion of the separator plate 20 replaced by a flat plate corresponding to the base-plane 50. In those tests the flame envelope covered 51, 51, 52 and 54%, respectively, of the window.

Figure 3:
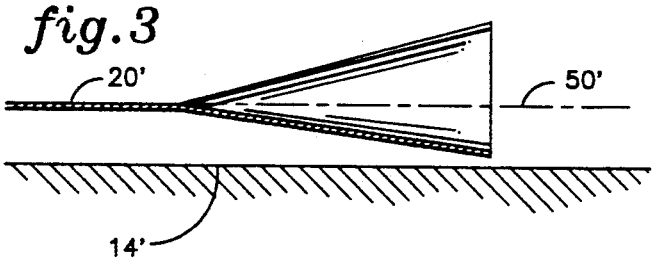
FIG. 3 illustrates a test configuration which did not perform well.

In another test an identical trough and lobe configuration was used; however the lower conduit wall did not have a ramp and did not have a step as represented by the surface 21. FIG. 3 shows that configuration The base-plane 50' and the plate 20' upstream of the convolutions were both parallel to the wall 14. The angles $\alpha$ and $\beta$ were the same as in the previous convoluted configuration. Three representative tests of the configuration of FIG. 3 resulted in flame envelope coverage of 62, 65 and 69%, respectively. These were not considered particularly good results. A similar configuration, but with considerably less trough depth (i.e A=2.54 cm), upper and lower trough aspect ratios both equal to 1.0, and trough profile angles $\alpha=\beta=15°$, produced even less coverage.

Figure 4:
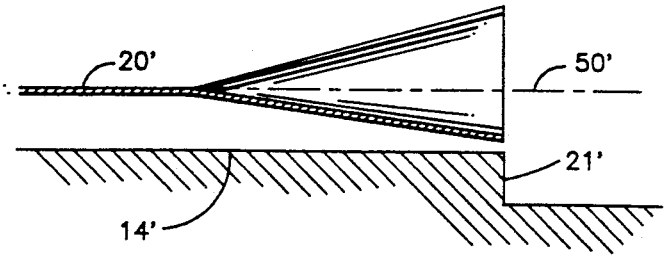
FIG. 4 illustrates another exemplary embodiment of the present invention.

Another configuration of the present invention which should perform as well as the configuration of FIGS. 1 and 2 is shown in FIG. 4. In that configuration the ramp has been eliminated (as in the configuration of FIG. 3), but the step 21' or recirculating region has been retained.

FIGS. 5 and 6 illustrate the use of the present invention in the afterburner section of a gas turbine engine, which is a form of combustion chamber. The drawing shows the rear portion of a gas turbine engine 53 in cross section. The engine centerline is designated 51.

That portion of the engine includes an exhaust duct 52 with an exhaust nozzle 54 shown schematically. An inner duct 56 defines a fan stream exhaust flow path 58. A tail cone 60 forms a turbine exhaust flow path 62, and an annular mixing region 64 where the fan and engine streams join each other. The last rotor stage 66 of a turbine and a turbine exhaust vane 68 are disposed in the turbine flow path 62. An annular gutter 69 of V-shaped cross section is disposed in the mixing region 64 between and adjacent a pair of annular plates 70, 72, each of which is convoluted at its downstream end in accordance with the teachings of the present invention. In this embodiment the inwardly facing troughs 74 of the outer convoluted plate 70 and the outwardly facing trough 76 of the inner convoluted plate 72 have parallel sidewalls. A spray bar 78 sprays fuel 79 into the mixing region 64 upstream of the plates 70, 72 and the gutter 69. When it is desired to operate the afterburner, ignition is accomplished by sending a momentary rich, burning fuel/air mixture from a burner through the engine exhaust stream. Alternatively, an igniter may be disposed within the gutter 69. Once the afterburner is lit, the flame remains anchored by the gutter 69, and is continuously maintained as long as fuel is being sprayed. The lobed mixers or convoluted plates 70, 72 produce the streamwise large scale vortex arrays within the fuel/air mixture which contacts the hot recirculating flow behind the gutter. Rapid propagation of the flame ensues, thereby shortening the required length of the afterburner. Momentum losses caused by the mixers and flameholder are less than the pressure losses generated by the multiple flameholder arrays used in conventional designs Although the invention has been shown and described with respect to a preferred embodiment thereof, it should be understood by those skilled in the art that other various changes and omissions in the form and detail of the invention may be made without departing from the spirit and scope thereof.

We claim:

1. A combustor having wall means defining a conduit for carrying field, oxidant, and combustion products in a downstream direction and for burning fuel and oxidant therein, said combustor including a separator plate disposed within said conduit, said plate having first and second opposed, downstream extending surfaces over which fluids within said conduit are adapted to flow, said plate having a downstream edge and a convoluted portion comprising a plurality of adjoining, alternating lobes and troughs extending downstream, each lobe and trough being smoothly U-shaped in cross section taken transverse to the downstream direction and blending smoothly with adjacent lobes and troughs, said lobes and troughs being spaced from said combustor wall means and terminating at said downstream edge, said lobe height and trough depth increasing continuously in the downstream direction to its maximum at said downstream edge, the contours and dimensions of said troughs and lobes being selected to ensure that each trough flows full and generates a pair of adjacent, large scale counterrotating vortices downstream of said edge within said conduit, each of said vortices rotating about an axis extending in the downstream direction, said combustor including means for creating and maintaining a recirculating flow region immediately adjacent and downstream of said downstream edge, said recirculation creating means including a step-wise increase in the cross-sectional flow area of said conduit immediately downstream of said downstream edge.

2. In a combustion process within a combustor having wall means defining a combustion chamber, the chamber having a separator plate disposed therewithin spaced from the chamber walls and extending in the downstream direction, the plate having a plurality of adjoining, alternating lobes and troughs extending downstream and terminating at the downstream edge of the plate, the improvement comprising:

creating a recirculating fluid region adjacent, immediately downstream of and extending substantially along the full length of the downstream edge of the plate, and transversely offset from the trough outlets;

flowing fluid in the downstream direction within the chamber over the lobes and within the troughs on each side of the plate, the bulk fluid flow on each side of the plate having substantially no angular momentum as it enters the troughs, wherein the fluid flowing over the plate includes a fuel and an oxidant;

maintaining full flow within the troughs during combustion;

rapidly mixing together the fluids on opposite sides of the plate by generating pairs of adjacent counterrotating vortices downstream of the plate, each pair of vortices made up of fluid from both sides of the plate, each of the vortices rotating about an axis extending in the downstream direction, and each vortex having a diameter on the scale of the depth of the downstream end of the trough; and causing the mixture of fluids to ignite within the recirculating fluid region immediately downstream of the plate and to have the upstream end of the flame remain attached at such location during combustion.

3. A combustor having wall means defining a conduit for carrying fuel, oxidant, and combustion products in a downstream direction and for burning fuel and oxidant therein, said combustor including a separator plate disposed within said conduit, said plate having first and second opposed, downstream extending surfaces over which fluids within said conduit are adapted to flow, said conduit including a first flow surface spaced from and facing said separator plate first surface and defining a downstream extending first flow path therebetween for a first fluid, said conduit also including a second downstream extending flow surface spaced from and facing said separator plate second surface and defining a downstream extending second flow path therebetween for a second fluid, said separator plate having a downstream edge and a convoluted portion comprising a plurality of adjoining, alternating lobes and troughs extending downstream, each lobe and trough being smoothly U-shaped in cross section taken transverse to the downstream direction and blending smoothly with adjacent lobes and troughs, said lobes and troughs being spaced from said combustor wall means and terminating at said downstream edge, said lobe height and trough depth increasing continuously in the downstream direction to its maximum at said downstream edge, the contours and dimensions of said troughs and lobes being selected to ensure that each trough flows full and generates a pair of adjacent, large scale counterrotating vortices downstream of said edge within said conduit, each of said vortices rotating about an axis extending in the downstream direction, wherein said convoluted downstream edge of said separator plate is adjacent said first conduit flow surface and said first conduit flow surface extends in the downstream direction over the length of said convoluted portion, wherein at said downstream edge of said separator plate said first conduit flow surface extends transversely of the downstream direction away from said separator plate first surface to create a recirculating flow region within said combustor immediately adjacent and downstream of said downstream edge.

4. The combustor according to claim 3 wherein said first flow path cross sectional flow area is substantially constant over the length of said convoluted portion.

5. A combustor having wall means defining a conduit for carrying fuel, oxidant, and combustion products in a downstream direction and for burning fuel and oxidant therein, said combustor including a separator plate disposed within said conduit, said plate having first and second opposed, downstream extending surfaces over which fluids within said conduit are adapted to flow, said plate having a downstream edge and a convoluted portion comprising a plurality of adjoining, alternating lobes and troughs extending downstream, each lobe and trough being smoothly U-shaped in cross section taken transverse to the downstream direction and blending smoothly with adjacent lobes and troughs, wherein each of said troughs has a pair of facing side walls, and each pair of said side walls of the troughs in at least one surface of said separator plate are substantially parallel to each other over their length, said lobes and troughs being spaced from said combustor wall means and terminating at said downstream edge, said lobe height and trough depth increasing continuously in the downstream direction to its maximum at said downstream edge, the contours and dimensions of said troughs and lobes being selected to ensure that each trough flows full and generates a pair of adjacent, large scale counterrotating vortices downstream of said edge within said conduit, each of said vortices rotating about an axis extending in the downstream direction, said combustor including means for creating and maintaining a recirculating flow region immediately adjacent and downstream of said downstream edge.

6. The combustor according to claim 5 wherein said side walls of each trough in both said first and second surfaces of said separator plate are substantially parallel to each other.

7. The combustor according to claim 5 wherein the aspect ratio of the troughs formed in at least one of said surfaces of said separator plate is between 2.0 and 10.0.

8. The combustor according to claim 7 wherein in at least one of said surfaces of said separator plate the slope of the troughs at said downstream edge is at least 10 degrees.

9. The combustor according to claim 7 wherein the trough depth at said plate downstream edge is at least 25 percent of the distance across said conduit as measured in the direction of trough depth.

10. The combustor according to claim 6, wherein the aspect ratio of the troughs formed in at least one of said surfaces of said separator plate is between 2.0 and 7.5, the slope of the troughs in at least one of said surfaces is at least 15° and the trough depth at said plate downstream edge is at least 25 percent of the distance across said conduit as measured in the direction of trough depth.

11. Afterburner means for a gas turbine engine, including wall means defining a conduit for carrying fuel, oxidant, and combustion products in a downstream direction and for burning fuel and oxidant therein, said afterburner including a pair of separator plates disposed within said conduit, each plate having first and second opposed, downstream extending surfaces over which fluids within said conduit are adapted to flow, each plate having a downstream edge and a convoluted portion comprising a plurality of adjoining, alternating lobes and troughs extending downstream, each lobe and trough being smoothly U-shaped in cross section taken transverse to the downstream direction and blending smoothly with adjacent lobes and troughs, said lobes and troughs being spaced from said afterburner wall means and terminating at said downstream edge, said lobe height and trough depth increasing continuously in the downstream direction to its maximum at said downstream edge, the contours and dimensions of said troughs and lobes being selected to ensure that each trough flows full and generates a pair of adjacent, large scale counterrotating vortices downstream of said edge within said conduit, each of said vortices rotating about an axis extending in the downstream direction, said afterburning means including a gutter of V-shaped cross section disposed within said conduit between said pair of plates and adjacent the convolutions of each plate, and located so as to create a recirculating flow region immediately adjacent and downstream of said downstream edge of said separator plates, said afterburner means also including fuel spray means upstream of said separator plate and gutter.

12. The combustor according to claim 11, wherein said gutter and said plates are annular, and the depth and height of said troughs and lobes is a radial dimension.

13. In a combustion process within a combustor having wall means defining a combustor chamber, the chamber having a separator plate disposed therewithin spaced from the chamber walls and extending in the downstream direction, the plate having a plurality of adjoining, alternating lobes and troughs extending downstream and terminating at their maximum height and depth, respectively, at the downstream edge of the plate, the improvement comprising:

flowing fluid in the downstream direction within the chamber over the lobes and within the troughs on each side of the plate, the bulk fluid flow on each side of the plate having substantially no angular momentum as it enters the troughs, wherein the fluid flowing over the plate includes a fuel and an oxidant, and wherein the bulk fluid on one side of the plate flows at a downstream velocity several times faster than the bulk fluid flowing on the other side of the plate and the slower of the two fluids is substantially entirely fuel;

maintaining full flow within the troughs during combustion;

rapidly mixing together the fluids on opposite sides of the plate by generating pairs of adjacent counterrotating vortices downstream of the plate, each pair of vortices made up of fluid from both sides of the plate, each of the vortices rotating about an axis extending in the downstream direction, and each vortex having a diameter on the scale of the depth of the downstream end of the trough; and causing the mixture of fluids to ignite immediately downstream of the plate and to remain lit at such location.

14. The combustion process according to claim 13, including the step of creating a recirculating fluid region adjacent, immediately downstream of and extending substantially along the full length of the downstream edge of the separator plate and transversely offset therefrom.

* * * * *